US010018008B2

(12) United States Patent
Cain et al.

(10) Patent No.: US 10,018,008 B2
(45) Date of Patent: Jul. 10, 2018

(54) COMPOSITE FRACTURE PLUG AND ASSOCIATED METHODS

(71) Applicant: Weatherford Technology Holdings, LLC, Houston, TX (US)

(72) Inventors: Brandon M. Cain, Houston, TX (US); Jason A. McGinnis, Tomball, TX (US)

(73) Assignee: Weatherford Technology Holdings, LLC, Houston, TX (US)

( * ) Notice: Subject to any disclaimer, the term of this patent is extended or adjusted under 35 U.S.C. 154(b) by 189 days.

(21) Appl. No.: 14/453,389

(22) Filed: Aug. 6, 2014

(65) Prior Publication Data

US 2016/0040499 A1 Feb. 11, 2016

(51) Int. Cl.

*E21B 33/04* (2006.01)
*E21B 19/00* (2006.01)
*E21B 23/01* (2006.01)

(52) U.S. Cl.

CPC ..... *E21B 33/04* (2013.01); *E21B 19/00* (2013.01); *E21B 23/01* (2013.01)

(58) Field of Classification Search

CPC ..... E21B 33/04; E21B 33/043; E21B 33/03; E21B 23/02; E21B 23/01; E21B 43/10

See application file for complete search history.

(56) References Cited

U.S. PATENT DOCUMENTS 2,010,284 A 8/1935 Wickersham
2,178,549 A 11/1939 Block
2,230,712 A * 2/1941 Bendeler ..... E21B 33/128 166/123
2,410,589 A 11/1946 Segelhorst
2,982,517 A * 5/1961 Tiraspolsky ..... E21B 4/02 415/123
3,297,344 A 1/1967 Hanes
3,437,356 A * 4/1969 Todd ..... E21B 33/0422 175/423
3,845,815 A 11/1974 Garwood
4,077,472 A * 3/1978 Gano ..... E21B 23/06 166/125

(Continued)

FOREIGN PATENT DOCUMENTS

GB 2410514 A 8/2005

OTHER PUBLICATIONS

Int'l Search Report and Written Opinion in counterpart PCT Appl. PCT/US2015/043363, dated Feb. 12, 2016.

*Primary Examiner* — Kipp C Wallace
(74) *Attorney, Agent, or Firm* — Blank Rome LLP

(57) ABSTRACT

On a wellhead, a well component, such as a casing head, has a bowl with a first shoulder and a groove defined therein. A hanger for supporting casing positions in the bowl, and a latch assembly on the hanger latches the hanger in the groove. The latch can have a traveling ring and a latch ring supported on the hanger's exterior surface. The traveling ring engages the first shoulder in the bowl and pushes the latch ring against a portion of the hanger, such as a second shoulder. The latch ring has a joint at a split in the latch ring, and the joint holds the latch ring in a compressed state about the exterior surface. When the latch ring moves with the engagement of the traveling ring against the hanger portion, the joint is disjointed, and the latch ring expands outward into the groove to latch the hanger in the bowl.

21 Claims, 6 Drawing Sheets

(56) References Cited

U.S. PATENT DOCUMENTS 4,460,042 A 7/1984 Galle, Jr.
4,528,738 A * 7/1985 Galle, Jr. ..... E21B 33/04 285/123.3
4,540,053 A 9/1985 Baugh et al.
4,550,782 A 11/1985 Lawson
4,595,063 A * 6/1986 Jennings ..... E21B 33/043 166/217
4,641,708 A 2/1987 Wightman
4,665,979 A 5/1987 Boehm, Jr.
4,730,851 A 3/1988 Watts
4,836,579 A * 6/1989 Wester ..... E21B 33/04 166/86.1
4,903,992 A 2/1990 Jennings et al.
4,919,460 A 4/1990 Milberger et al.
5,020,593 A 6/1991 Milberger
5,070,942 A * 12/1991 McInnes ..... E21B 33/04 166/115
5,160,172 A 11/1992 Gariepy
5,421,407 A 6/1995 Thornburrow
5,560,426 A * 10/1996 Trahan ..... E21B 23/04 166/120
5,577,556 A 11/1996 Reed
5,944,111 A 8/1999 Bridges
5,984,008 A 11/1999 Lang et al.
6,125,939 A 10/2000 Abreco, Jr.
6,138,751 A 10/2000 Hart
6,202,745 B1 3/2001 Reimert et al.
6,516,875 B2 2/2003 Reilly et al.
6,598,673 B1 7/2003 Hosie et al.
6,920,925 B2 7/2005 Duhn et al.
7,040,407 B2 5/2006 Jennings et al.
7,134,490 B2 * 11/2006 Nguyen ..... E21B 33/0422 166/208
7,150,323 B2 12/2006 Ford
7,299,867 B2 11/2007 Hall et al.
7,380,607 B2 6/2008 Thomas
7,441,594 B2 10/2008 Vanderford et al.
7,445,046 B2 11/2008 Borak, Jr.
7,900,706 B2 3/2011 Ford
8,074,724 B2 12/2011 Minassian et al.
8,136,604 B2 3/2012 Jennings
8,157,006 B2 4/2012 Koleilat et al.
8,297,366 B2 10/2012 Olvera et al.
8,413,730 B2 4/2013 Gette et al.
8,511,393 B2 8/2013 Nguyen
2006/0016604 A1 1/2006 Ford
2012/0160511 A1 6/2012 Gette
2012/0312542 A1 12/2012 Varhese et al.
2013/0068466 A1 3/2013 Ghumre et al.
2013/0146306 A1 6/2013 Yates et al.
2013/0180705 A1 * 7/2013 Fuglestad ..... E21B 33/128 166/135

* cited by examiner

COMPOSITE FRACTURE PLUG AND ASSOCIATED METHODS

BACKGROUND OF THE DISCLOSURE

Casing hangers are used in casing heads to support casing in a well. One problem that has existed for some time is how to mechanically latch the casing hanger into an existing internal groove of the casing head. The goal is to create a reliable latch that will hold hanger and minimize installation time.

Multiple techniques have been used in the art to achieve the latching. The simplest technique uses a biased latch ring that is compressed to a smaller diameter as it is forced into the casing head. This latch ring then springs outward once it has passed over the internal latching groove. Other techniques use rotation from threaded members to spread the latch ring or use hydraulics to move the latch ring radially outward.

The subject matter of the present disclosure is directed to overcoming, or at least reducing the effects of, one or more of the problems set forth above.

SUMMARY OF THE DISCLOSURE

A hanger is disclosed for landing in a bowl and latching in an internal groove of the bowl. The hanger comprises a hanger body for positioning in the bowl and comprises a latch. The hanger body has an exterior surface, and the latch is supported on the exterior surface.

The latch has a split ring with a joint holding the split ring in a compressed state about the exterior surface. The joint in the split ring can comprise a weld formed at a split in the split ring or can comprise a fixture disposed at a split in the split ring. In response to engagement of the latch in the bowl, the joint disjoints, and the split ring expands outward into the internal groove in response to the disjointing.

In one arrangement, the latch comprises a traveling ring supported on the exterior surface and supporting the split ring. The traveling ring is engagable with the bowl and moves the split ring against a portion of the hanger body. One or more temporary connections can hold the traveling ring supported temporarily on the exterior surface.

In one arrangement, the exterior surface of the hanger body can define a sloped shoulder that can expand the split ring radially outward when moved thereagainst and can disjoint the joint. In another arrangement, the exterior surface of the hanger body can define a protrusion protruding from the exterior surface. The protrusion can expand the split ring radially outward when moved thereagainst and can disjoint the joint.

A wellhead is also disclosed having a well component and the disclosed hanger. The well component has a bowl with a first shoulder and an internal groove defined therein. The disclosed hanger for positioning in the bowl has a second shoulder extending from the exterior surface. For the arrangement of the latch having the traveling ring and the split ring, the traveling ring supported on the exterior surface can engage with the first shoulder in the bowl. The latch ring moves with the engagement of the traveling ring and disjoints the joint with engagement against a second shoulder on the hanger.

In a method of landing a hanger in a bowl of a well component having an internal groove and a first shoulder, a split ring is jointed in a compressed state on an exterior surface of the hanger. The hanger positions in the bowl, and the split ring disjoints in response to engagement against the first shoulder. The hanger latches in the well component by expanding the split ring outward into the internal groove in response to the disjointing.

Disjointing the split ring in response to the engagement against the first shoulder can involve moving the split ring on the exterior surface in response to the engagement against the first shoulder. For instance, a traveling ring on the hanger can engage against the first shoulder and can move the split ring.

Disjointing the split ring can involve breaking the jointing of the split ring, moved on the exterior surface, with a portion of the hanger. For example, breaking the jointing of the split ring can involve wedging the split ring against a second shoulder on the hanger. Alternatively or additionally, breaking the jointing of the split ring can involve wedging the split ring against a protrusion on the hanger.

The foregoing summary is not intended to summarize each potential embodiment or every aspect of the present disclosure.

DETAILED DESCRIPTION OF THE DISCLOSURE

Figure 1:
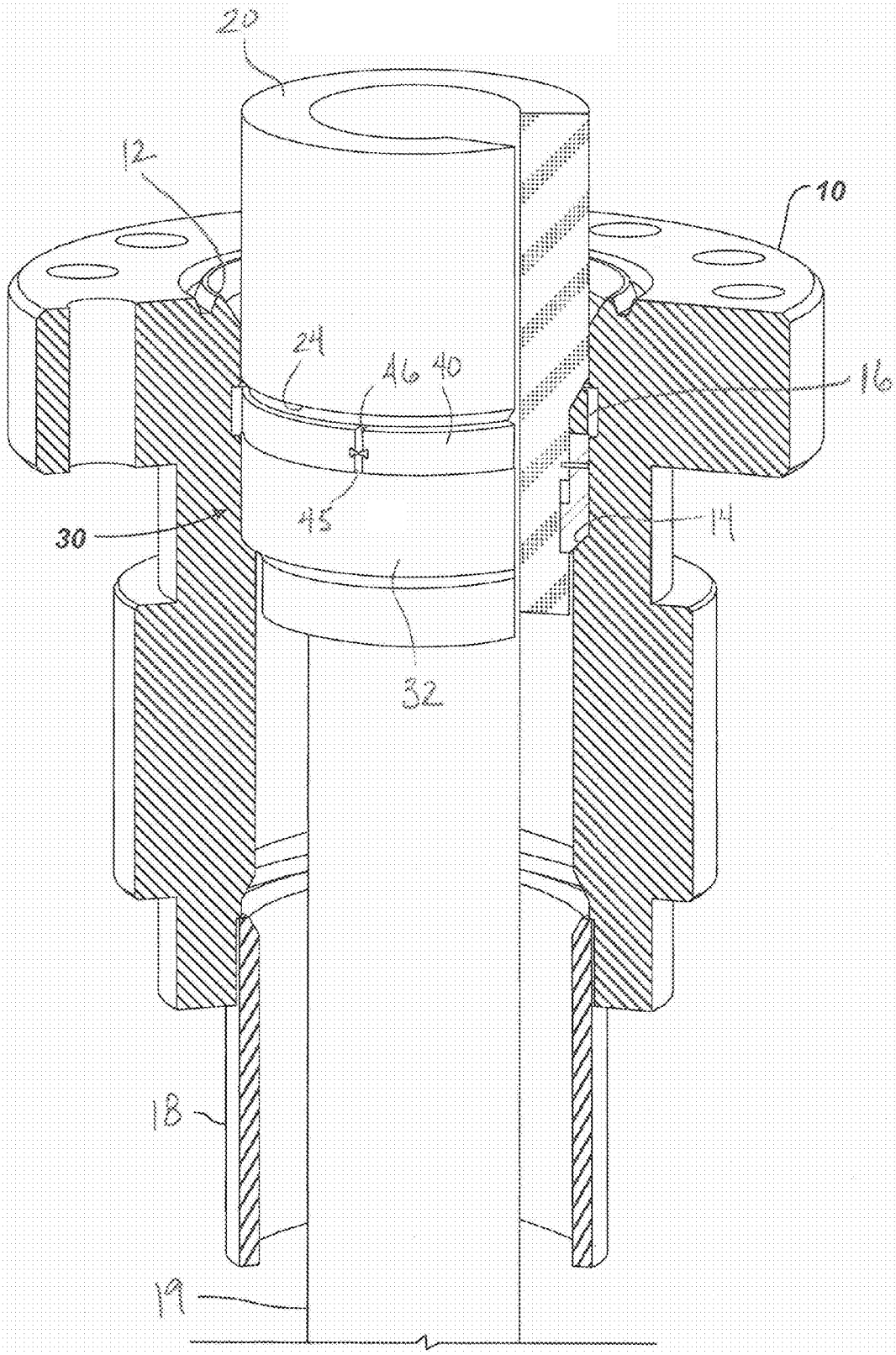
FIG. 1 illustrates a partial cross-sectional view of a casing hanger having a latch system according to the present disclosure being run into a casing head.

FIG. 1 illustrates a partial cross-sectional view of a casing hanger 20 having a latch system 30 according to the present disclosure being run into a casing head 10. As is typical, the casing head 10 mounts on outer casing 18, and the casing hanger 20 supports inner casing 19 and is intended to land in the bowl 12 of the casing head 10 to support the inner casing 19 downhole. Other wellhead components (not shown) can mount above the casing head 10, and the upper end of the casing hanger 20 may have additional features not shown here for simplicity.

The latch system 30 is incorporated into the casing hanger 20 and is configured to latch or lock the hanger 20 landed in the casing head 10, meaning the latch system 30 at least prevents uphole movement of the hanger 20 in the head 10. The latch system 30 includes a traveling ring 32 and a latch or split ring 40. For assembly, the latch ring 40 is forced into a compressed state and is held in that state by a tack weld, pin, fixture, or other joint 46 at the split or gap 45 in the latch ring 40.

When the casing hanger 20 with the latch system 30 is installed in the casing head 10, the traveling ring 32 engages the landing shoulder 14 in the head's bowl 12, and the vertical weight of the casing hanger 20 is translated into an outward radial force and/or a cutting/wedging action that breaks the latch ring's joint 46. Freed by the disjointing, the compressed latch ring 40 biases outward into the head's internal latch groove 16. At that point, the latch ring 40 operates as needed.

Figure 2A:
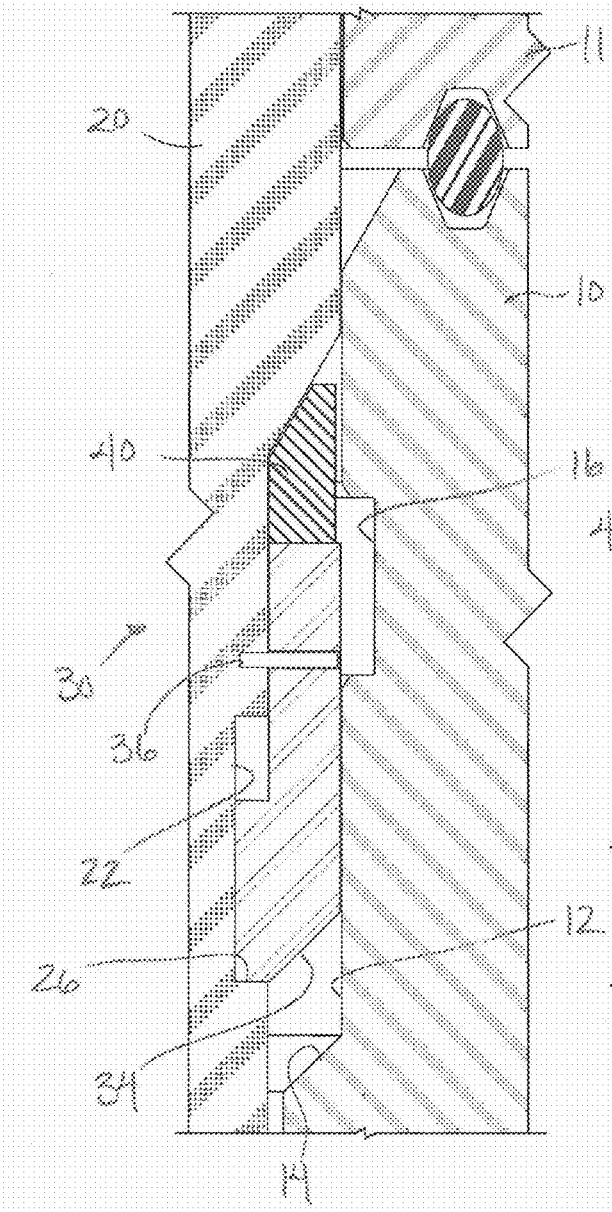
FIG. 2A illustrates a detailed cross-sectional view of the casing hanger having the latch system according to the present disclosure being run into the casing head.

In the detailed cross-sectional view of FIG. 2A, the casing hanger 20 is being shown run into the casing head 10. The internal bowl 12 of the head 10 is shown with the landing shoulder 14 for supporting the casing hanger 20. The internal lock groove 16 is defined around the internal bowl 12 at a position above the shoulder 14. As shown, a tubing spool 11 or other wellhead component can be installed on the casing head 10 to support additional wellhead elements. Downhole of the shoulder 14, the casing head 10 can connect to outer casing (18: FIG. 1) and can communicate downhole according to standard practice.

The casing hanger 20 has an exterior surface 22 with the latch system 30 disposed thereon. The latch system 30 includes the traveling ring 32, which can be a solid ring. The traveling ring 32 can slide in place on the hanger 20 and can be retained by a shallow lower shoulder 26 or the like on the hanger's exterior surface 22. Although not strictly necessary, the traveling ring 32 can be temporarily affixed in place on the exterior surface 22 with one or more shear pins 36 or other temporary connections.

A lower end or shoulder 34 of this traveling ring 32 is configured to engage the landing shoulder 14 of the head 10. The upper end of the traveling ring 32 supports the latch ring 40, which rests adjacent a sloped shoulder 24 on the hanger 20.

As FIG. 2A shows during run in, the latch ring 40 is prevented from scraping along the inside diameter of the casing head 10. Therefore, damage to the latch ring 40 can be avoided. Additionally, it is possible to reciprocate the hanger 20 and attached casing string (19: FIG. 1) in the casing head 10 during cementing or other operations without damaging the latch ring 40 or other components of the latch system 30.

Figure 2B:
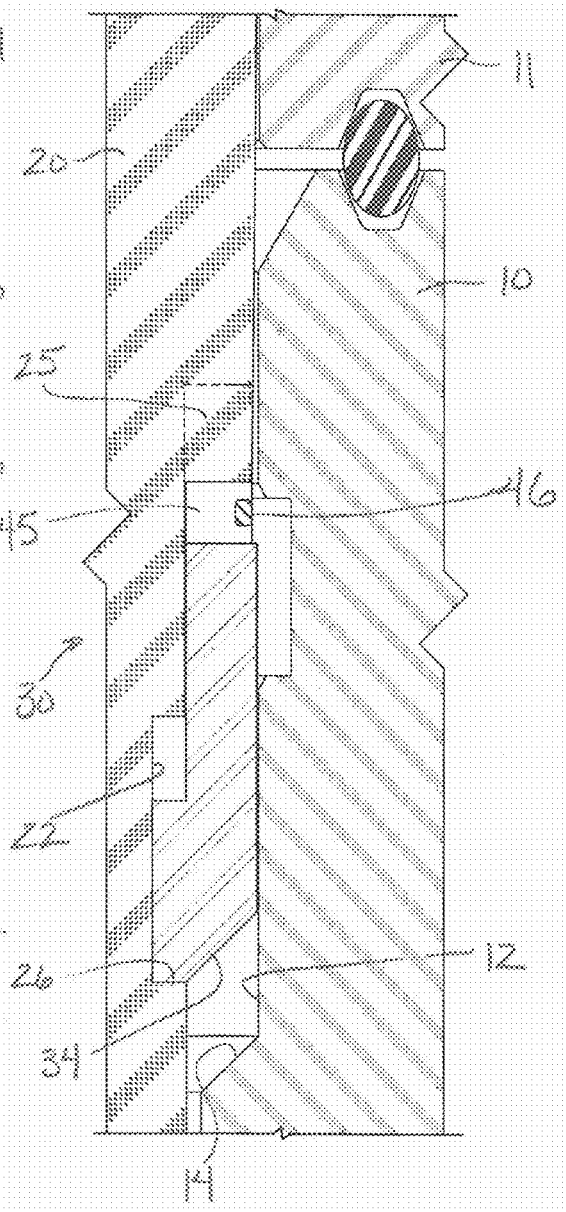
FIG. 2B illustrates another detailed cross-sectional view at another orientation of the casing hanger being run into the casing head.

In the detailed cross-sectional view of FIG. 2B at another orientation of the casing hanger 20, the sloped shoulder 24 on the hanger 20 can include a stub, a wedge, or other protrusion 25 in one embodiment. This protrusion 25 can fit at least partially in the split 45 of the latch ring 40 where the joint 46 is located. During landing of the casing hanger 20, the protrusion 25 can aid in breaking the joint 46 to free the latch ring 40 to bias outward. Other embodiments may use only the protrusion 25 at an orthogonal (non-sloped) shoulder to break the joint 46, or embodiments may not use the protrusion 25 and may instead rely primarily of the sloped shoulder 24 to break the joint 46.

Figure 3A:
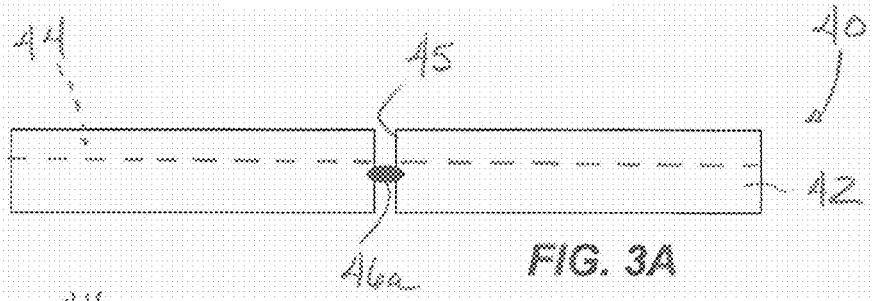
FIG. 3A illustrates a side view of a first latch ring having a joint according to the present disclosure.
Figure 3B:
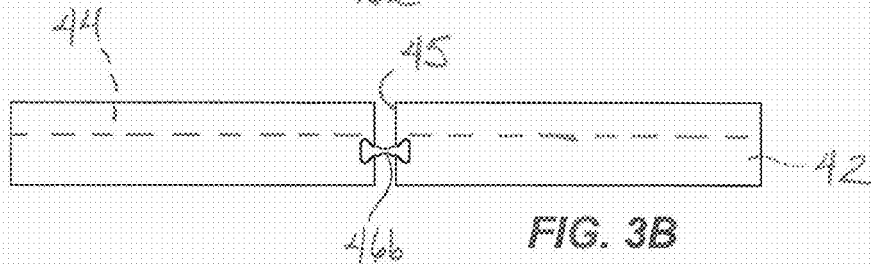
FIG. 3B illustrates a side view of a second latch ring having another joint according to the present disclosure.

For example, FIG. 3A illustrates a side view of a latch ring 40 having one type of joint 46*a*, while FIG. 3B illustrates a side view of a latch ring 40 having another type of joint 46*b*. The joint 46*a* in FIG. 3A is a tack weld made in the split 45 of the ring body 42 of the latch ring 40. By contrast, the joint 46*b* in FIG. 3B is a fixture holding together edges of the gap 45 of the ring's body 42. This fixture for the joint 46*b* can be a shear plate or other component that fits in slots at the split 45 to hold the spilt 45 together and to keep the latch ring 40 in a compressed state. Such a fixture for the joint 46*b* may be further affixed or welded in place if necessary.

The latch rings 40 of FIGS. 3A-3B are configured to expand radially outward when the joint 46*a-b* is broken during landing of the casing hanger (20). Breaking the joints 46*a-b* for these latch rings 40 can be achieved primarily with interaction of the ring 40 moving on the casing hanger (20) and engaging the sloped shoulder (24) on the hanger (20) that stresses the ring 40 outward and breaks the joint 46*a-b* in tension.

Figure 4A:
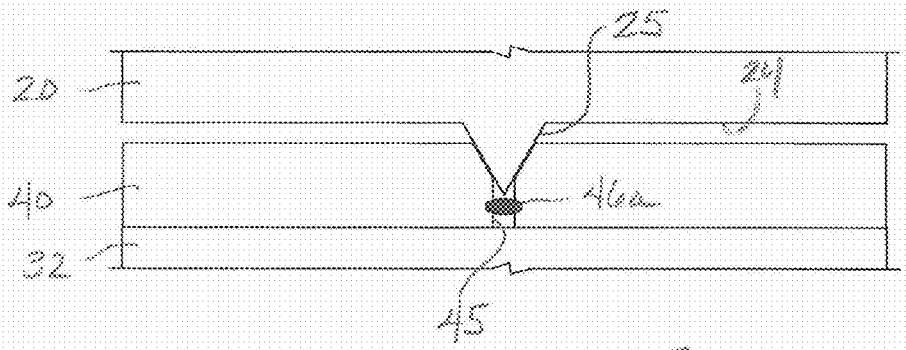
FIG. 4A illustrates a side view of a third latch ring disposed relative to the casing hanger and a traveling ring.

As an alternative embodiment noted above, a stub, wedge, or other protrusion 25 on the hanger 20 can fit at least partially in the gap 45 of the latch ring 40 where the joint 46 is located. For example, FIG. 4A illustrates a side view of a latch ring 40 disposed relative to the casing hanger 20 and the traveling ring 30. This ring 40 has the first type of joint 46*a* (e.g., tack weld). The hanger 20 has a protrusion 25, which is depicted here as a wedge shape extending from the shoulder 24. For its part, FIG. 4B illustrates a side view of the latch ring 40 with the second joint 46*b* (e.g., fixture) relative to the protrusion 25.

Figure 4B:
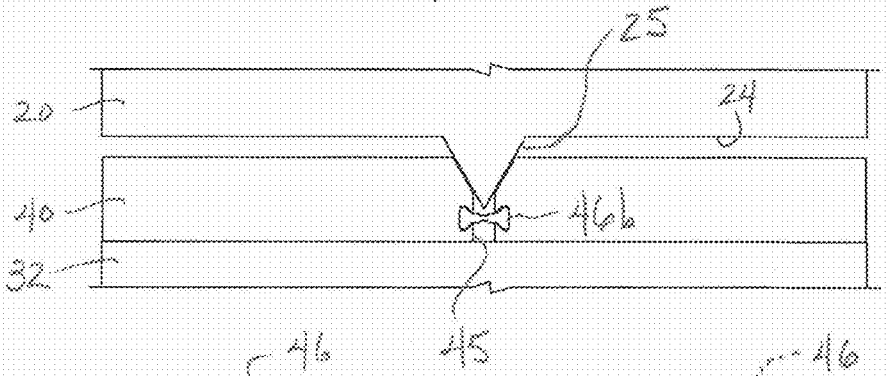
FIG. 4B illustrates a side view of a fourth latch ring disposed relative to the casing hanger and the traveling ring.

As before, the latch rings 40 of FIGS. 4A-4B are configured to expand radially outward when the joint 46*a-b* is broken during landing of the casing hanger (20). Breaking the joints 46*a-b* for these rings 40 can be achieved with interaction of the protrusion 25 with the ring 40 and the joint 46*a-b* while moving on the casing hanger (20). Additionally, breaking the joints 46*a-b* can be achieved through the engagement with the hanger's sloped shoulder 24 that stresses the ring 40 outward. Either way, the force stresses the ring 40 outward and breaks the joint 46*a-b* in tension. It may even be possible that the protrusion 25 uses a cutting action that breaks the joint 46*a-b*.

Figure 5A:
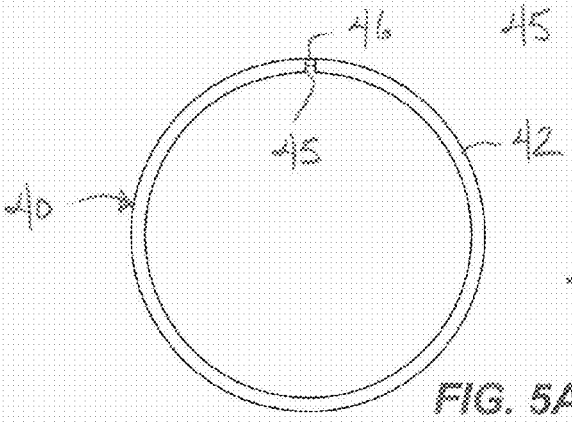
FIGS. 5A-5B illustrate plan views of additional latch rings.
Figure 5B:
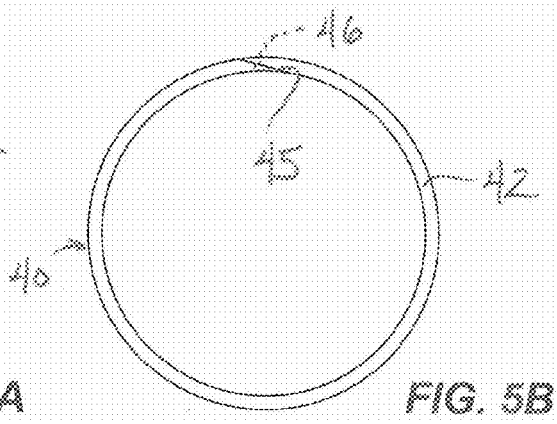

Additional plan views of latch rings are shown in FIGS. 5A-5B. In FIG. 5A, the ring body 42 of the latch ring 40 is shown with the joint 46 configured, formed, installed, etc. at the split 45. Here, the joint 46 can include the tack weld or fixture as noted above, which spans across the gap or split 45 in the latch ring 40. In FIG. 5B, the ring body 42 has overlapping ends at the split 45 that are held together by the joint 46, which can be a shear pin, for example. As these latch rings 40 and joints 46 in FIGS. 3A to 5B show, ends of the split 45 on the ring's body 42 can be held together in a number of ways, which can even be combined with one another.

Landing of the hanger 20 and latching of the latch ring 40 will now be discussed with reference to FIGS. 6A-6B. As first shown in FIG. 6A, the latch system 30 and the hanger 20 can initially engage the shoulder 14 in the casing head 10 as the hanger 20 is landed during run in. Once the hanger 20 has been landed on the load shoulder 14, the string's weight is transferred to the hanger 20.

In particular, weight is placed on the traveling ring's end 34 against the shoulder 14, and the one or more shear pins 36, if present, retaining the traveling ring 32 break. In the end, the landing engagement frees the traveling ring 32 to move along the exterior surface 22 of the hanger 20, as shown in FIG. 6B. The joint (46) on the latch ring 40 then shears or breaks, allowing the bias of the latch ring 40 to expand the ring 40 outward. This shearing or breaking of the ring's joint (46) can be configured for a particular implementation and may typically be around 3000-5000 lbs.

With the ring's joint (46) sheared, the biased-out latch ring 40 can spring outward from its compressed state. Accordingly, the latch ring 40 expands outwardly into the internal groove 16 of the head 10 to lock the hanger 20 in the head 10. The hanger 20 is then secure in the head's bowl 12.

Figures 6A, 6B:
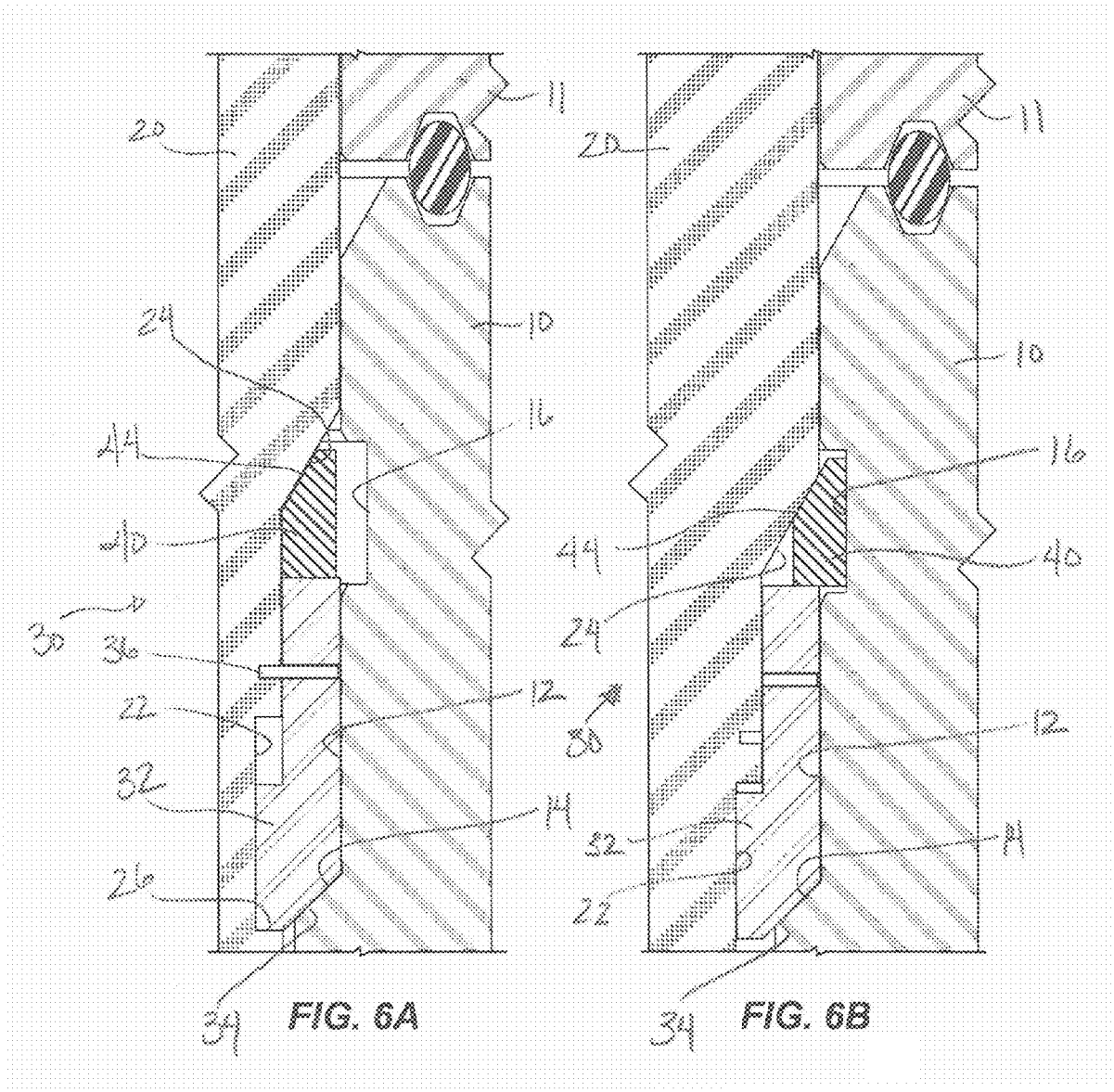
FIG. 6A illustrates a detailed cross-sectional view of the casing hanger having the latch system initially engaging a shoulder in the casing head.
FIG. 6B illustrates a detailed cross-sectional view of the casing hanger having the latch system engaged in a lock groove of the casing head.

In particular and as depicted in FIG. 6B, the latch 30 constrains first (downhole) movement of the hanger 20 through the engagement of the split ring's shoulder 44 with the hanger's shoulder 24, the engagement of the latch ring 40 with the traveling ring 32, and the engagement of the lower slope on the outside of the traveling ring 32 with the head's shoulder 14. (Alternatively or additionally, the bottom edge of the latch ring 40 can engage the bottom shoulder of the groove 16.) Likewise, the latch 30 can constrain second (uphole) movement of the hanger 20 through the engagement of the latch ring 40 with the upper shoulder of the groove 16. In this case, the latch ring 40 can be supported by the traveling ring 32, which can be supported by the lower shoulder 26 on the hanger's exterior surface or by a shoulder of some other component.

As discussed above, the outward expansion of the ring 40 occurs in part due to the inside slope 44 of the ring 40 against the sloped shoulder 24 of the hanger 20. However, the outward expansion also occurs due to the biased spring force released from the latch ring 40 as the hanger's upper shoulder 24 and/or protrusion 25 shears, cuts, severs, or otherwise breaks the joint 46 at the gap 45 of the ring 40, as shown in the view of FIGS. 7A-7B.

Figures 7A, 7B:
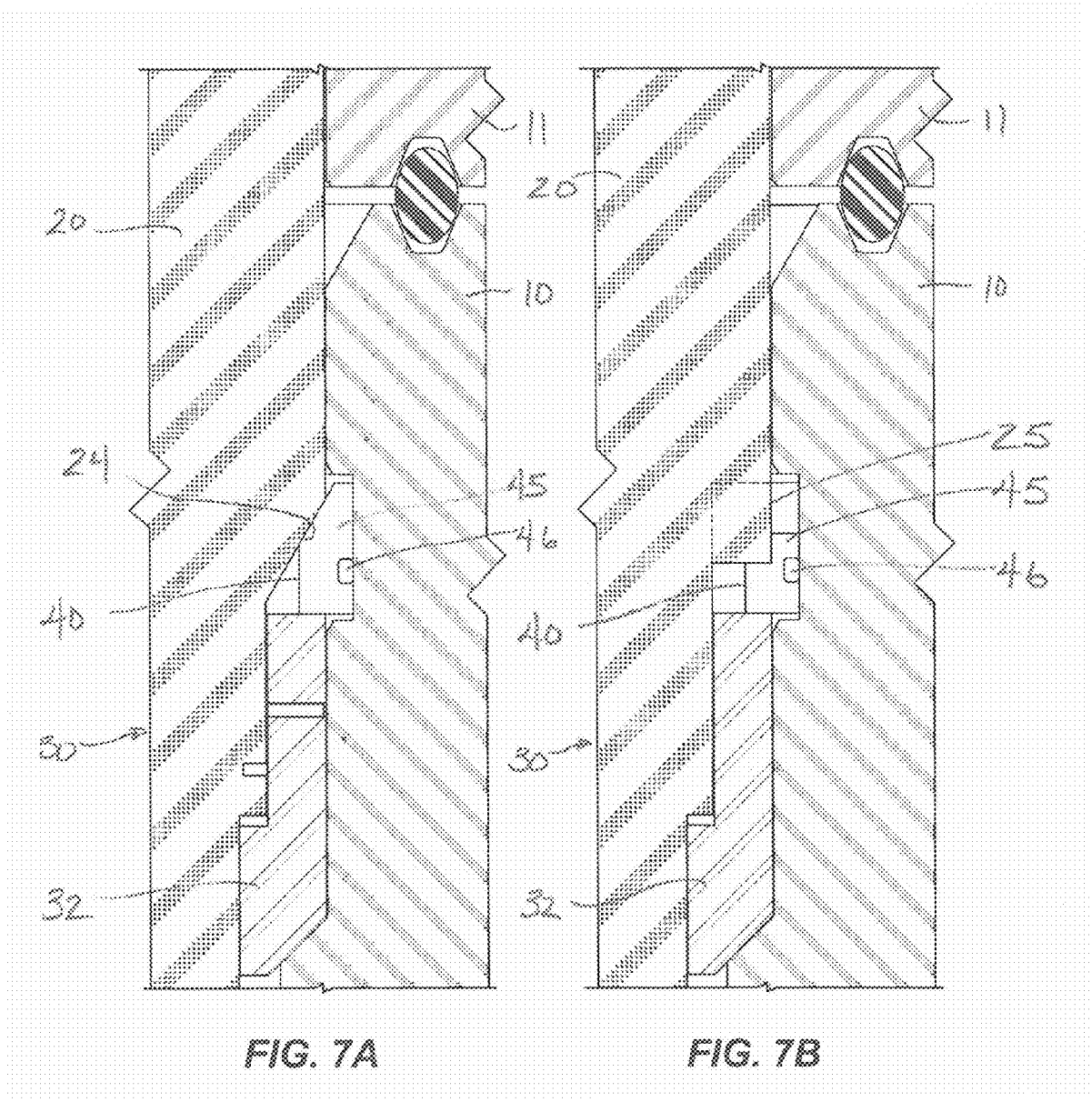
FIGS. 7A-7B illustrate detailed cross-sectional views at another orientation of the latch system engaged in the lock groove of the casing head.

For example, FIGS. 7A-7B illustrate detailed cross-sectional views at another orientation of the latch system 30 engaged in the lock groove 16 of the casing head 10. In FIG. 7A, the split 45 of the latch ring 40 is shown with the joint 46 severed primarily by the wedging action of the sloped shoulder 24 on the casing hanger 20. In FIG. 7B, the split 45 of the latch ring 40 is shown with the joint 46 severed by wedging action of the protrusion 25 on the casing hanger 20. As noted above, this protrusion 25 extends from the retention shoulder 24 on the hanger's exterior 22 and can be a splitting wedge or other protrusion. When load is transferred, the latch ring's joint 46 is forced against the splitting wedge 25 until the point where the joint 46 is sheared by tension and possibly even cutting.

In previous embodiments, the latch system 30 has included a separate traveling ring 32 and split latch ring 40. In another arrangement, features of these two components can be combined together for the latch system 30. For example, FIGS. 8A-8B illustrate detailed cross-sectional views of another latch system 30 for engaging in the groove 16 of the casing head 10, and FIG. 9 illustrates a side view of an example latch ring 40 for the system 30 of FIGS. 8A-8B.

Figure 8A:
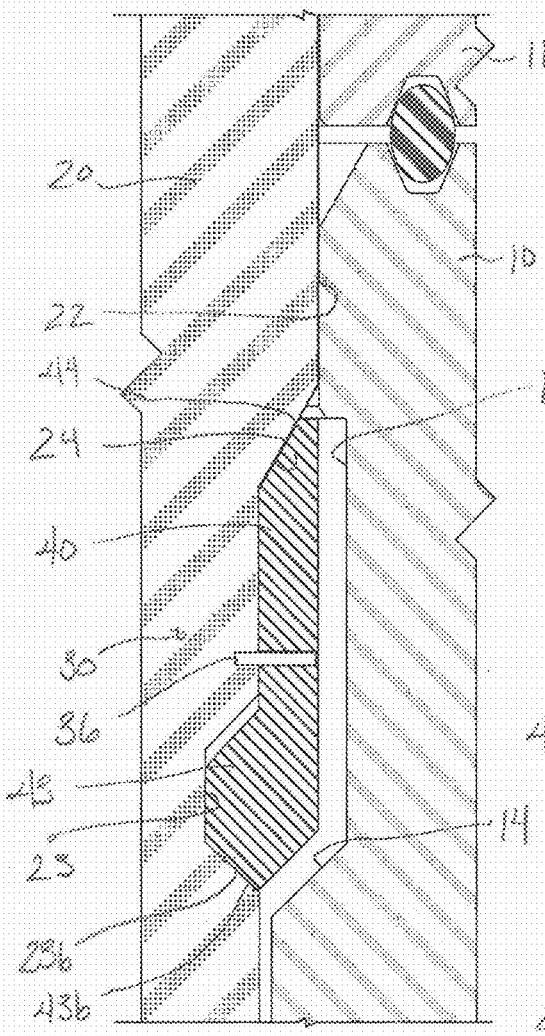
FIGS. 8A-8B illustrate detailed cross-sectional views of another latch system for engaging in a lock groove of the casing head.
Figure 8B:
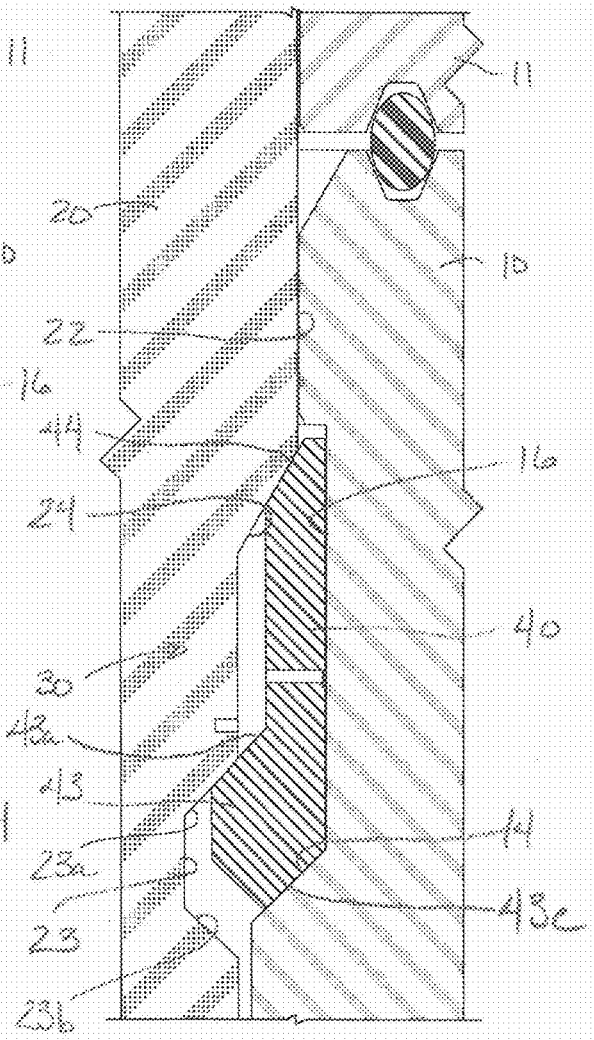

As shown in FIG. 8A, the latch system 30 includes a split latch ring 40 that is held to the exterior surface 22 of the casing hanger 20. A sloped upper end 44 of the latch ring 40 rests against the slopped shoulder 24 of the hanger 20, and a lower shouldered end 43 of the ring 40 fits in a lower retention slot 23 in the hanger 20. These shoulders, ends, and slots can hold the ring 40 in place. Although not strictly necessary, the ring 40 can be temporarily affixed in place on the exterior surface 22 with one or more shear pins 36 or other temporary connections.

Figure 9:
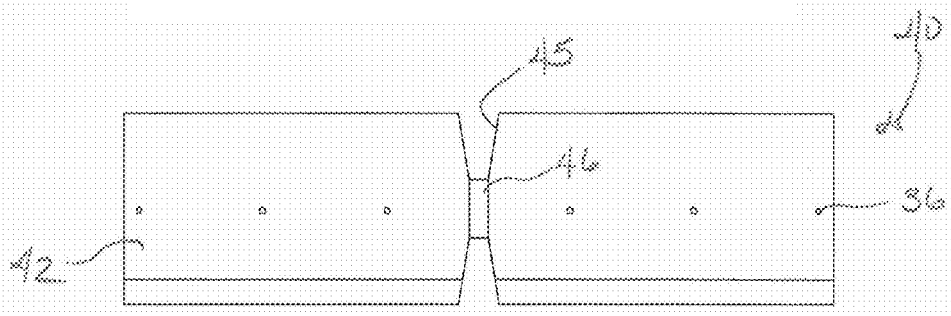
FIG. 9 illustrates a side view of a latch ring for the system of FIGS. 8A-8B.

As before, the latch ring 40 shown in FIG. 9 has a ring body 42 with a split 45. The diameter of the ring body 42 is compressed, and a joint 46 (e.g., fixture, tack weld, etc.) holds the ring 40 in its compressed state. When the joint 46 is broken, the biased body 42 of the ring 40 can then expand radially outward to it unbiased state.

As FIG. 8A shows during run in, the latch ring 40 is held in the compressed state against the exterior surface 22 of the hanger 20 so the ring 40 is prevented from scraping along the inside diameter of the casing head 10. Therefore, it is possible to reciprocate the hanger 20 and attached casing string (19: FIG. 1) in the casing head 10 during cementing or other operations without damaging the latch ring 40 or other components.

As then shown in FIG. 8B, the latch system 30 and the casing hanger 20 can initially engage the shoulder 14 in the casing head 10 as the hanger 20 is landed during run in. Once the hanger 20 has been landed on the load shoulder 14, the string's weight is transferred to the hanger 20.

As weight is placed on the ring's shouldered end 43 against the shoulder 14, the one or more shear pins 36, if present to retain the ring 40, break. In the end, the landing engagement frees the ring 40 to move along the exterior surface 22 of the hanger 20. The joint (46) on the latch ring 40 then shears or breaks, allowing the bias of the latch ring 40 to expand the ring 40 outward, and the latch ring 40 expands outwardly into the internal groove 16 of the head 10 to lock the hanger 20 in the head 10. The hanger 20 is then secure in the head's bowl 12.

In particular and as depicted in FIG. 8B, the ring 40 constrains first (downhole) movement of the hanger 20 through the engagement of the hanger's shoulder 24 with the ring's sloped upper end 44, the engagement of the upper slope 23*a* of the slot 23 with upper slope 43*a* on the inside of the end 43, and the engagement of the lower slope 23*c* on the outside of the end 43 with the head's shoulder 14. Likewise, the ring 40 constrains second (uphole) movement of the hanger 20 through the engagement of the ring's end 44 with the upper shoulder of the groove 16 and the engagement of the lower slope 43*b* on the inside of the end 43 with the lower slope 23*b* on the slot 23.

For each of the various latch rings 40 disclosed above, there are at least two ways in which to install the latch ring 40 of the present disclosure on the casing hanger 20. In one technique, the latch ring 40 with the split 45 is formed to have its expected external dimension for engaging in the internal groove 16. The latch ring 40 is then placed in a separate fixture at a compressed state with the split 45 brought together. In this compressed state, the latch ring 40 has an internal dimension desired to fit within acceptable tolerance on the exterior surface 22 of the hanger 20. While held in the compressed state in the separate fixture, operators then form (attach, weld, etc.) the joint 46 at the split 45 to hold the ring 40 in the compressed state.

Once ready, the latch ring 40 can be removed from the fixture and then slid onto the exterior 22 of the casing hanger 20 to abut against the sloped shoulder 24. Because the latch ring 40 may attempt to deform from a circular shape, external support may be required to hold the ring 40 and slide it on the hanger 20. Once the ring 40 is set in place, the traveling ring 32, which constitutes a full ring without a split, slides on the casing hanger 20 to abut against the latch ring 40. Finally, operators affix the traveling ring 32 in place on the hanger 20 with the one or more shear pins 36 or other temporary connection.

In another technique, the latch ring 40 with the split 45 is formed to have its expected external dimension for engaging in the internal groove 16. The latch ring 40 is then placed directly on the casing hanger's exterior surface 22 and is pressed around its circumference into its compressed state on the hanger 20. To compress the ring 40, a separate fixture can install around the ring 40 and hanger 20 to decrease the ring's circumference about the exterior surface 22. While held in the compressed state on the hanger 20, operators then form (attach, weld, etc.) the joint 46 at the split 45 to hold the ring 40 in the compressed state.

Once ready, the latch ring 40 can be moved to abut against the sloped shoulder 24, and the traveling ring 32 can be slid on the casing hanger 20 to abut against the latch ring 40. Finally, operators affix the traveling ring 32 in place on the hanger 20 with the one or more shear pins 36 or other temporary connection. For those embodiments not using a traveling ring 32, the shear pins 36 can affix the latch ring 40 to the hanger 20. These and other techniques can be used to install the latch system 30 on the casing hanger 20.

The foregoing description of preferred and other embodiments is not intended to limit or restrict the scope or applicability of the inventive concepts conceived of by the Applicants. It will be appreciated with the benefit of the present disclosure that features described above in accordance with any embodiment or aspect of the disclosed subject matter can be utilized, either alone or in combination, with any other described feature, in any other embodiment or aspect of the disclosed subject matter. Although the latch system 30 for the casing hanger 20 has been described herein for use with a casing head 10, it will be appreciated that the latch system 30 and hanger 20 can be used for landing in a bowl of a casing head, a tubing spool, a tubular, or any other well component. Additionally, the hanger 20 can be used for hanging casing, tubing, or any suitable well component.

In exchange for disclosing the inventive concepts contained herein, the Applicants desire all patent rights afforded by the appended claims. Therefore, it is intended that the appended claims include all modifications and alterations to the full extent that they come within the scope of the following claims or the equivalents thereof.

What is claimed is:

1. A hanger for landing in a first direction on a first shoulder in a bowl and latching in a second direction opposite the first direction in an internal groove of the bowl, the first shoulder facing in the second direction, the hanger comprising:

a hanger body for positioning in the bowl, the hanger body having an exterior surface with a second shoulder facing the first direction for supporting the hanger body, the exterior surface of the hanger body defining a protrusion protruding therefrom; and a latch supported on the exterior surface and having a split connected by a joint, the joint holding the latch in a compressed state about the exterior surface and disjointing in response to engagement of the latch in the bowl and to engagement of the protrusion with the joint, the latch expanding outward into the internal groove in response to the disjointing, the latch having third and fourth shoulders supporting the hanger body in the first direction in the bowl respectively between the first and second shoulders, the latch expanded into the internal groove having a fifth shoulder facing in the second direction, the hanger body having a sixth shoulder on the exterior surface facing in the second direction, the latch having a seventh shoulder facing in the first direction and engageable with the sixth shoulder of the hanger body with movement of the hanger body in the second direction, the fifth shoulder of the latch expanded into the internal grove and moved in the second direction constraining the movement of the hanger body in the second direction from the bowl against the internal groove.

2. The hanger of claim 1, wherein the joint comprises a weld formed at the split in the latch.

3. The hanger of claim 1, wherein the joint comprises a fixture disposed at the split in the latch.

4. The hanger of claim 1, further comprising one or more temporary connections holding the latch supported temporarily on the exterior surface.

5. The hanger of claim 1, wherein the second shoulder on the exterior surface of the hanger body expands the latch radially outward, when the latch is moved in the second direction thereagainst, and disjoints the joint.

6. The hanger of claim 5, wherein the exterior surface of the hanger body defines the protrusion protruding from the second shoulder and engageable with the joint.

7. The hanger of claim 1, wherein the second shoulder of the hanger body has separate sections engageable with corresponding separate sections on the fourth shoulder on the latch.

8. A hanger for landing in a first direction on a first shoulder in a bowl of a well component having an internal groove in the bowl, the first shoulder facing in a second direction opposite the first direction, the hanger comprising:

a hanger body for positioning in the first direction in the bowl, the hanger body having an exterior surface and having a second shoulder extending from the exterior surface in the first direction, the exterior surface of the hanger body defining a protrusion protruding therefrom;

a traveling ring supported on the exterior surface and having a third shoulder engagable with the first shoulder in the bowl; and a latch ring supported on the exterior surface and having a joint at a split in the latch ring, the joint holding the latch ring in a compressed state about the exterior surface, the latch ring movable in the second direction with the engagement of the third shoulder of the traveling ring against the first shoulder in the bowl, the joint disjointing with engagement of the latch ring against the second shoulder of the hanger body and with engagement of the protrusion with the joint, the latch ring expanding outward into the internal groove in response to the disjointing, the third shoulder of the traveling ring and a fourth shoulder of the latch ring supporting the hanger body in the first direction in the bowl respectively between the first and second shoulders, the hanger body having a sixth shoulder on the exterior surface facing in the second direction, the traveling ring having a seventh shoulder facing in the first direction and engageable with the sixth shoulder of the hanger body with movement of the hanger body in the second direction, the latch ring expanded into the internal groove having a fifth shoulder facing in the second direction, the fifth shoulder constraining the movement of the hanger body in the second direction from the bowl against the internal groove.

9. The hanger of claim 8, wherein the joint comprises a weld formed at the split in the latch ring.

10. The hanger of claim 8, wherein the joint comprises a fixture disposed at the split in the latch ring.

11. The hanger of claim 8, further comprising one or more temporary connections holding the traveling ring supported temporarily on the exterior surface.

12. The hanger of claim 8, wherein the second shoulder on the exterior surface of the hanger body expands the latch ring radially outward, when the latch ring is moved in the second direction thereagainst, and disjoints the joint.

13. The hanger of claim 12, wherein the exterior surface of the hanger body defines the protrusion protruding from the second shoulder and engageable with the joint.

14. The hanger of claim 8, wherein the latch ring has a first end facing in the first direction; and wherein the traveling ring has a second end facing in the second direction, the first and second ends engageable with one another.

15. A wellhead, comprising:

a well component having a bowl with a first shoulder and an internal groove defined therein, the first shoulder facing in a second direction opposite a first direction;

a hanger for positioning in the first direction in the bowl, the hanger having an exterior surface and having a second shoulder extending from the exterior surface in the first direction, the exterior surface of the hanger body defining a protrusion protruding therefrom;

a traveling ring supported on the exterior surface and having a third shoulder engagable with the first shoulder in the bowl; and a latch ring supported on the exterior surface and having a joint at a split in the latch ring, the joint holding the latch ring in a compressed state about the exterior surface, the latch ring movable in the second direction with the engagement of the third shoulder of the traveling ring against the first shoulder in the bowl, the joint disjointing with engagement of the latch ring against the second shoulder of the hanger and with engagement of the protrusion with the joint, the latch ring expanding outward into the internal groove in response to the disjointing, the third shoulder of the traveling ring and a fourth shoulder of the latch ring supporting the hanger body in the first direction in the bowl respectively between the first and second shoulders, the hanger body having a sixth shoulder on the exterior surface facing in the second direction, the traveling ring having a seventh shoulder facing in the first direction and engageable with the sixth shoulder of the hanger body moved in the second direction, the latch ring expanded into the internal groove having a fifth shoulder facing in the second direction and constraining movement of the hanger body in the second direction from the bowl against the internal groove.

16. A method of landing a hanger in a first direction in a bowl of a well component having an internal groove and a first shoulder, the first shoulder facing in a second direction opposite the first direction, the method comprising:

jointing a split of a latch in a compressed state on an exterior surface of the hanger, the latch having a third shoulder facing in the first direction and having a fourth shoulder facing in the second direction;

positioning the hanger in the first direction in the bowl, the hanger having a second shoulder facing in the first direction, the exterior surface of the hanger body defining a protrusion protruding therefrom;

disjointing the split of the latch in response to engagement of the third shoulder of the latch against the first shoulder of the bowl, engagement of the fourth shoulder of the latch with the second shoulder of the hanger, and engagement of the protrusion with the joint of the split; and latching the hanger in the well component by expanding the latch outward into the internal groove in response to the disjointing, supporting the hanger in the first direction in the bowl with the third and fourth shoulders of the latch respectively between the first shoulder of the bowl and the second shoulder of the hanger, and constraining movement of the hanger in the second direction from the bowl with engagement of a sixth shoulder of the hanger with a seventh shoulder of the latch and with engagement of a fifth shoulder of the latch with the internal groove of the bowl.

17. The method of claim 16, wherein disjointing the split comprises moving the latch in the second direction on the exterior surface in response to the engagement.

18. The method of claim 17, wherein moving the latch in the second direction on the exterior surface in response to the engagement comprises:

engaging the third shoulder of a traveling ring of the latch on the hanger against the first shoulder of the bowl;

moving the traveling ring in the second direction with the engagement; and moving a split ring of the latch in the second direction with the traveling ring.

19. The method of claim 18, wherein disjointing the latch in response to the engagement comprises breaking the jointing of the split ring, moved in the second direction on the exterior surface, with the protrusion of the hanger.

20. The method of claim 19, wherein breaking the jointing of the split ring, moved in the second direction on the exterior surface, with the protrusion of the hanger comprises breaking the jointing of the split ring by wedging the split ring against the second shoulder on the hanger.

21. The method of claim 19, wherein breaking the jointing of the split ring, moved on the exterior surface, with the protrusion of the hanger comprises breaking the jointing of the split ring by wedging the split ring against the protrusion on the hanger.

* * * * *